US009343048B2

(12) United States Patent
Shepherd

(10) Patent No.: US 9,343,048 B2
(45) Date of Patent: May 17, 2016

(54) DRUM RIM RAISING DEVICE WITH A PIEZOELECTRIC SENSOR AND A FORCE SENSOR

(71) Applicant: James Frederick Shepherd, Woodside, NY (US)

(72) Inventor: James Frederick Shepherd, Woodside, NY (US)

( * ) Notice: Subject to any disclaimer, the term of this patent is extended or adjusted under 35 U.S.C. 154(b) by 5 days.

(21) Appl. No.: 14/231,738

(22) Filed: Mar. 31, 2014

(65) Prior Publication Data

US 2014/0208926 A1 Jul. 31, 2014

Related U.S. Application Data

(63) Continuation-in-part of application No. 13/506,775, filed on May 15, 2012, now abandoned, which is a continuation of application No. 12/831,243, filed on Jul. 6, 2010, now Pat. No. 8,178,768, which is a continuation-in-part of application No. 11/055,250, filed on May 16, 2005, now Pat. No. 7,772,473.

(51) Int. Cl.

| | |
|---|---|
| ***G10H 1/06*** | (2006.01) |
| ***G10D 13/02*** | (2006.01) |
| ***G10H 3/14*** | (2006.01) |

(52) U.S. Cl.

CPC ..... *G10D 13/021* (2013.01); *G10H 3/146* (2013.01); *G10H 2230/301* (2013.01); *G10H 2240/211* (2013.01)

(58) Field of Classification Search

CPC ..... G10H 3/146; G10H 2220/525; G10H 2230/301; G10H 2230/275; G10H 3/14; G10H 1/32; G10H 2220/561; G10D 13/024; G10D 13/027; G10D 13/02; G10D 13/026; G10K 11/004; G10G 5/005

See application file for complete search history.

(56) References Cited

U.S. PATENT DOCUMENTS

| | | | | |
|---|---|---|---|---|
| 5,353,674 | A * | 10/1994 | Volpp | 84/411 R |
| 2003/0061932 | A1* | 4/2003 | Tanaka et al. | 84/734 |
| 2004/0025663 | A1* | 2/2004 | Harada et al. | 84/104 |
| 2007/0234886 | A1* | 10/2007 | Matsuyuki et al. | 84/723 |
| 2008/0282867 | A1* | 11/2008 | Liu | 84/411 P |
| 2012/0097009 | A1* | 4/2012 | Eventoff et al. | 84/413 |
| 2013/0112068 | A1* | 5/2013 | Rogers | 84/723 |
| 2014/0157972 | A1* | 6/2014 | Mori | 84/723 |
| 2014/0208926 | A1* | 7/2014 | Shepherd | 84/730 |
| 2015/0179154 | A1* | 6/2015 | Takegawa | 84/723 |

* cited by examiner

*Primary Examiner* — Marlon Fletcher
(74) *Attorney, Agent, or Firm* — Michael D. Eisenberg

(57) ABSTRACT

A rim raising device attaches to a drum rim, or operates remotely from a drum. The device provides additional elevation above the drum, and increased surface area to a section of the drum rim such that a percussion technique is enhanced. The increased elevation provides space for other components to attach to the drum rim. A trigger assembly comprises at least one piezoelectric sensor and/or at least one force sensor that detect the force. The piezoelectric sensor generates an intensity sensitive signal. The force sensor generates an on/off, linear signal that produces sound, or serves as a gate for the piezoelectric sensor. The force converts into both types of signals, and wirelessly transmitted to a sound module for generating a predetermined sound. A transmitter on the device uses wireless technology, or an instrument cable/wire to transmit the signal. A vibration suppression portion inhibits interferences and other unwanted vibrations.

19 Claims, 6 Drawing Sheets

DRUM RIM RAISING DEVICE WITH A PIEZOELECTRIC SENSOR AND A FORCE SENSOR

TECHNICAL FIELD

The present invention relates to drum rim risers with triggers and multiple sensors, and more particularly, some embodiments relate to a rim raising device that attaches to a section of a drum rim, or peripheral area of a rimless drum to help facilitate and enhance a percussion technique by creating elevation above the drum rim, and utilizing an intensity sensitive sensor and a linear sensor for detecting and transmitting a force that strikes the device mounted on the drum to generate a predetermined sound.

BACKGROUND OF THE INVENTION

The subject invention generally relates to drum rim risers.

Typically, a drum is a member of the percussion group of musical instruments. Drums consist of at least one membrane that is stretched over a shell and struck, either directly with the player's hands, or with a drum stick, or any other percussion or striking element to produce sound. There is usually a resonance head on the underside of the drum, typically tuned to a slightly lower pitch than the top drumhead. A drum rim forms a circumference atop the drum, and can be used as part of the contact surface for playing the drum and positioning the drum sticks.

It is well known that an electronic drum is an electronic synthesizer that mimics an acoustic drum kit. The electronic drum usually consists of a set of pads mounted on a stand in a disposition similar to an acoustic drum kit. Each pad has a sensor that generates an electric signal when struck.

Typically, a rim click technique involves placing a tip of a drum stick on a drum head, near the center. The shaft of the drum stick is tapped against the drum rim. This creates a dry clicking sound.

Often, a piezoelectric sensor is a device that uses the piezoelectric effect to measure pressure, acceleration, strain or force by converting them to an electrical charge. The electrical charge is proportional to the intensity of the force. A force sensor creates a change in electrical resistance when a force is applied. The change in resistance creates a voltage.

It is known that there is a need for consistent and accurate cross sticking or rim clicking, and a solution to the limitations related to rim playing in any form on a drum. The action of a drummer playing a cross sticking technique requires sufficient space above the drum to form a firm grasp on the drum stick whose tip or butt rests on the drum head. A remote drum rim, separate from the drum, and transmitting the sounds from the drum rim could provide increased playing options.

Even though the above cited drum rim raisers address some of the needs of the market, a rim raising device that enhances a percussion technique by creating elevation above the drum rim, and sensing and transmitting a force that strikes the device mounted on the drum is still desired.

BRIEF SUMMARY OF EMBODIMENTS OF THE INVENTION

According to one variant of the invention, the rim raising device attaches to a section of a drum rim to help facilitate and enhance a percussion technique. The rim raising device enables enhanced percussion techniques for electrical and acoustic drums by providing a realistic feel for the drum rim without the mechanical drawbacks and limitations that often accompany a drum rim. The rim raising device utilizes at least one piezoelectric sensor and at least one force sensor, having different functionalities to generate a signal for creating acoustic energy.

In some variants, the rim raising device may provide additional elevation and surface area to a section of the drum rim such that manipulation for a percussion technique, such as a cross stick technique, is facilitated and enhanced. Those skilled in the art, in light of the present teachings, will recognize that a cross stick or rim click technique involves placing one end of a first drum stick on a drum head, and a second end of the first drum stick on the rim. In the case of a cross stick play, a second drum stick may then strike the first drum stick and/or the drum head to produce a dry clicking sound. Thus, providing additional elevation to the section of the drum rim supporting the first drum stick produces multiple advantages, such as more space for grasping the first drum stick, more space for manipulating the first drum stick, and more configurations for generating different sounds from the drum and the drum sticks. The increased elevation and additional surface area offered by the rim raising device may also enable at least one piezoelectric sensor, at least one force sensor sensors, transmitters, wiring, and other electronic components to attach to the drum rim.

In one variant of the present invention, the configuration and positioning of the rim raising device in relation to the drum serves to create additional space between the rim raising device and the drum rim. This additional space may facilitate manipulations and control of a drum stick when performing the percussion techniques. For example, increasing the elevation of a drum stick during a cross stick or rim click technique creates more space for a body part to maneuver, and creates more variety of sounds when striking the drum or the drum stick.

In one variant, a triggering assembly detects a force on a contact portion of the drum, and triggers the subsequently generated signal to a transmitter for generating a predetermined sound. The triggering assembly comprises at least one piezoelectric sensor and at least one force sensor.

In one variant, at least one piezoelectric sensor and at least one force sensor position on the rim raising device. The at least one piezoelectric sensor is configured to convert the force of the at least one drum stick into a signal that is proportional to an intensity of the force. The at least one piezoelectric sensor is operable to measure pressure, acceleration, strain, or force produced by the drum stick striking the drum. The force creates a deformation in a piezoelectric material, such as a piezoelectric ceramic, whereby the deformation generates a voltage. The intensity of the voltage forms the signal, which transmits to a remote trigger interface into conversion to an acoustic energy.

The triggering assembly may further utilize at least one force sensor. The at least one force sensor is configured to convert the force from the at least one drum stick into either an on signal or an off signal in the form of voltage. Unlike the at least one piezoelectric sensor, which generates a voltage that is proportional to an intensity of the force, the at least one force sensor either generates a predetermined voltage, or does not generate any voltage. In this manner, the at least one force sensor may provide two novel functions.

In one function, the at least one force sensor generates a signal, comprising a predetermined linear voltage that transmits to the remote trigger interface into conversion to an acoustic energy. Those skilled in the art will recognize that the predetermined linear voltage generated by the at least one force sensor forms a different acoustic energy than a signal that is proportional to an intensity of the force, such as what the at least one piezoelectric sensor generates.

In a second function, the at least one force sensor serves as a gate or switch for actuating the at least one piezoelectric sensor. In this manner, the at least one piezoelectric sensor may be actuated to generate a signal, not through direct contact from the drum stick, but by the force expanded onto the force sensor. In some embodiments, the at least one force sensor positions above and engages the at least one piezoelectric sensor for instigating contact between the two sensors.

The at least one force sensor serves as a triggering mechanism to convert the force generated by a drum stick striking the rim raising device and the drum into a linear signal. The linear signal may then be wirelessly transmitted or sent by wire to a remote trigger interface for conversion into a predetermined sound. In this manner, the rim raising device may mount directly onto the drum rim, or serve as an independent instrument, remotely positioned from the drum. Additionally, the rim raising device may include a vibration suppression device to at least partially inhibiting vibrations and other unwanted consequences created while performing the percussion techniques.

In one aspect of the present invention, the rim raising device comprises:

an arc section, the arc section being configured to enhance or augment an existing drum rim for enabling a more comfortable and natural grip on at least one drum stick when performing a percussion technique, and for enhancing a sound generated by striking a drum with the at least one drum stick;

the arc section comprising a contact portion, the contact portion being configured to engage the at least one drum stick and/or a body part, the arc section further comprising a mounting portion, the mounting portion being disposed to mount the arc section on a mounting surface, the arc section further comprising a sidewall, the sidewall being configured to elevate the contact portion over a circumference of the mounting surface, wherein the contact portion is spaced apart vertically above the mounting surface for creating an air space between the contact portion and the mounting surface;

a triggering assembly, the triggering assembly being configured to detect a force on the contact portion and perform a predetermined action for generating a predetermined sound, the triggering assembly comprising at least one piezoelectric sensor, the at least one piezoelectric sensor being configured to convert the force into an intensity sensitive signal that is proportional to an intensity of the force, the triggering assembly further comprising at least one force sensor, the at least one force sensor being configured to convert the force into a linear signal that is either on or off, the at least one force sensor further being configured to actuate the at least one piezoelectric sensor in response to the force, the triggering assembly further comprising a transmitter, the transmitter being configured to transmit the intensity sensitive signal and/or the linear signal to a remote trigger interface, the remote trigger interface being configured to convert the intensity sensitive signal and/or the linear signal into an acoustic energy for generating the predetermined sound;

wherein the intensity sensitive signal and the linear signal generate different acoustic energies; and a vibration suppression portion, the vibration suppression portion being configured to help suppress a vibration from the force.

In yet another aspect, the rim raising device creates additional air space between the contact portion of the arc section and the drum rim. The air space provides more space to firmly grasp the drum stick. The improved grip enables a more controlled, accurate swing of the drum stick, which is necessary for the cross stick technique and other percussion techniques.

In yet another aspect, the at least one piezoelectric sensor converts the force generated by striking the drum and the rim raising device into a signal that is proportional to an intensity of the force. The signal may then be carried wirelessly, or through a transducer wire, to a remote trigger interface via an instrument cable or wire for conversion into acoustic energy in the form of a predetermined sound.

In another aspect, a vibration suppression portion, such as a anti-vibration rubber diffusion piece, positions on the drum raising device to help inhibit at least one sympathetic vibration from at least one section of the drum or drum rim.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

FIG. 1A is an outer view, and FIG. 1B is an inner view, in accordance with the principles of the invention;

FIG. 2A is a front exterior view, and FIG. 2B is a rear exterior view, in accordance with the principles of the invention;

FIG. 3A is a lower housing view of the rim raising device, and FIG. 3B is an upper housing view of the rim raising device, in accordance with the principles of the invention;

FIG. 4A is an upper housing view of the rim raising device with a piezoelectric sensor, FIG. 4B is an upper housing view of the rim raising device with a force sensor, and FIG. 4C is a lower housing view of the rim raising device with a plurality of ribs for the force sensor, in accordance with the principles of the invention; FIG. 5A is a triggering assembly with two piezoelectric sensors and a force sensor, FIG. 5B is a triggering assembly with two piezoelectric sensors in parallel configuration, and FIG. 5C is a triggering assembly with two piezoelectric sensors in stereo/dual channel configuration, in accordance with the principles of the invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The present invention relates to rim raising devices and, more particularly, some embodiments relate to a rim raising device 5 that attaches to a section of a drum rim to help facilitate and enhance a percussion technique by providing additional elevation above the drum rim for enhanced manipulation of a precision mallet, detecting the intensity of a force from the drum stick striking the drum and the rim raising device 5, and wirelessly transmitting a signal from the device 5 to a remote trigger interface (not shown) for generating a predetermined sound. Unwanted vibrations, such as cross talk interference from different sections of the drum, are also partially inhibited with a vibration suppression portion 105 that attaches to the rim raising device 5. The rim raising device 5 may be utilized with a variety of drums, including, without limitation, snare drums, tom drums, electrical drums, riding toms, hi-hat stands, Djembe, and any other drum structure having a free standing accessory where additional sounds are desired or acoustical benefits can be realized. The percussion technique may include, without limitation, a cross stick technique, a rim click technique, a rim shot technique, a one-handed-roll technique, and the like.

Figure 1A:
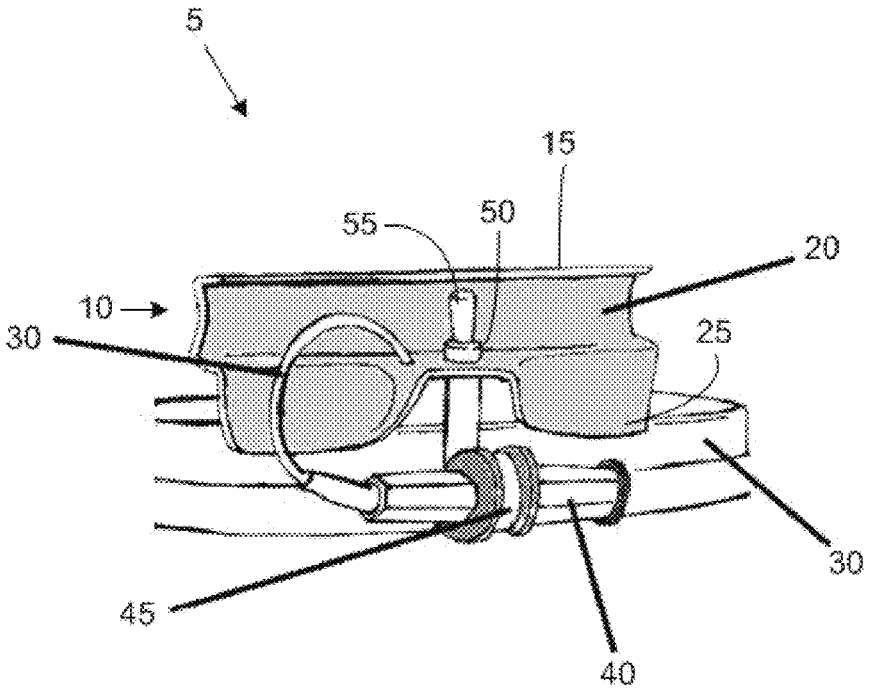
FIGS. 1A and 1B are detailed perspective views of an exemplary rim raising device mounted on an exemplary drum rim, where
Figure 1B:
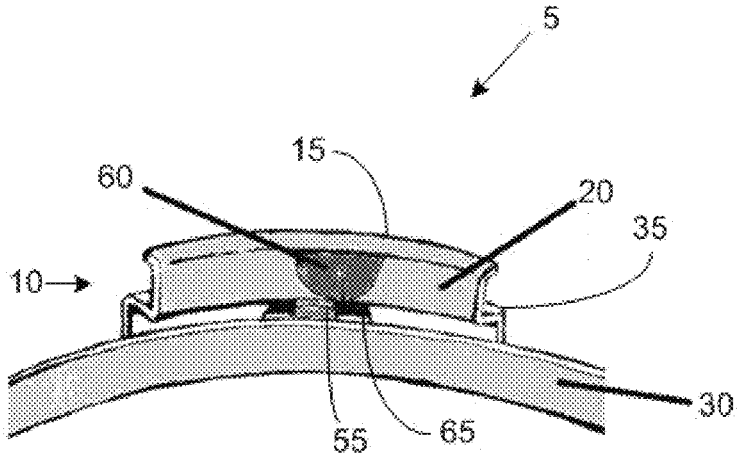

In one variant of the present invention, referring to FIG. 1, a rim raising device 5 attaches to a mounting surface 30, such as a drum rim. The configuration and positioning of the rim raising device 5 in relation to a drum serves to create additional space between the rim raising device 5 and the mounting surface 30. The mounting surface 30 may include, without limitation, the drum rim, and a remote area in proximity to the drum. The space created between the rim raising device 5 and the mounting surface 30 may facilitate manipulations and control of at least one drum stick when performing at least one percussion technique. For example, increasing the elevation of a drum stick during a cross stick technique creates more space for a body part to grasp the at least one drum stick for greater control, and creates more variety of sounds when striking the drum or the at least one drum stick.

The rim raising device 5 comprises an arc section 10 that is sized and dimension to contour the arc of a circumference on the drum rim (FIG. 1A). In one embodiment, the arc section 10 is 2-9" long. The arc section 10 may comprise of an upper housing 85 and a lower housing 90 that join together to form the arc section 10. The lower housing may contain a power source 95 for powering the rim raising device 5. The power source 95 may include, without limitation, a battery, a rechargeable battery, a solar panel, and an external power source. In some embodiments, the arc section 10 includes a contact portion 15 for engaging at least one drum stick and a body part. The drum stick may include, without limitation, a pair of drum sticks, a percussion mallet, a brush, and a rod. The body part may include a wrist or a hand that rests on the contact portion 15 when performing the percussion technique. For purposes of the cross stick technique, a first drum stick has a striking end that rests near the center of the drum, and a grasping end that rests on the contact portion 15. A second drum stick strikes the first drum stick and/or the drum to produce the desired effect. The arc section 10 comprises a sidewall 20 that elevates the contact portion 15 over a circumference of the mounting surface 30. The sidewall 20 may include a sidewall aperture 65 for wiring to pass through.

For purposes of the rim click technique, a drum stick has a striking end that rests near the center of the drum, and a grasping end that rest on the contact portion 15. The drum stick strikes the drum to produce the desired effect. The arc section 10 comprises a sidewall 20 that elevates the contact portion 15 over a circumference of the mounting surface 30. The sidewall 20 may include a sidewall aperture 65 for wiring to pass through.

The arc section 10 may further include a mounting portion 25 for engaging the mounting surface 30. The mounting portion 25 may comprise a lower housing 90 of the rim raising device 5, opposite the contact portion 15. In one variant, the mounting portion 25 mounts onto a circumference section of the drum rim. The mounting portion 25 comprises a flange 35 that extends from the sidewall 20. The flange 35 may align with an existing flange on the drum rim. The flange 35 comprises at least one flange aperture 100 for at least partially enabling a fastener to pass through at least one threaded spacer 50. The fastener may include, without limitation, a threaded bolt, a screw, a magnet, and an adhesive. In this manner, the arc section 10 attaches to the rim raising device 5, and can be tightened onto the rim raising device 5 through an existing tension rod 55 of the drum or a supplemental tension rod 55 that comes with the rim raising device 5. At least one steel spacer (not shown) positioned on the tension rod 55, and under the flange 35 may be added or removed to create smaller elevation adjustments for the rim raising device 5.

In some variants, the mounting portion 25 may utilize additional means to secure to the mounting surface 30. The mounting portion 25 may include at least one mounting aperture 110. The at least one mounting aperture 110 is configured to enable at least partial entry of a mounting fastener for securing the arc section 10 to the mounting surface 30. The mounting fastener may include, without limitation, a threaded bolt, a screw, a magnet, and an adhesive.

Figure 2A:
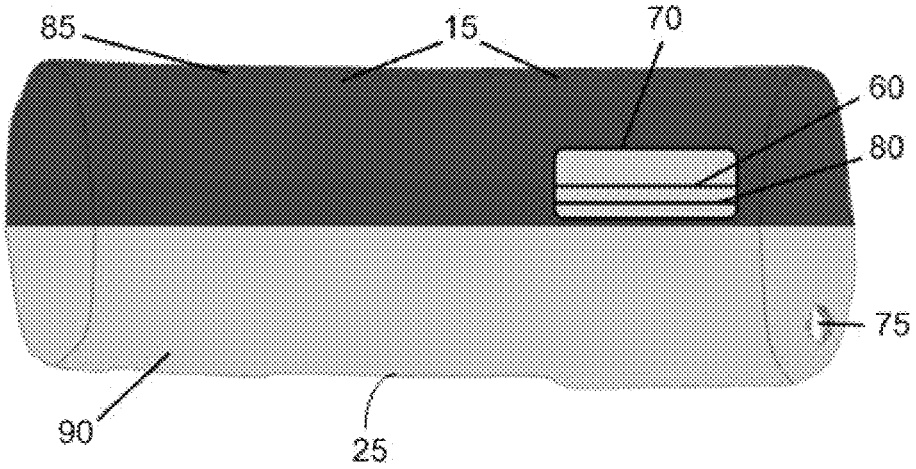
FIGS. 2A and 2B are detailed perspective views of an exemplary rim raising device, where
Figure 2B:
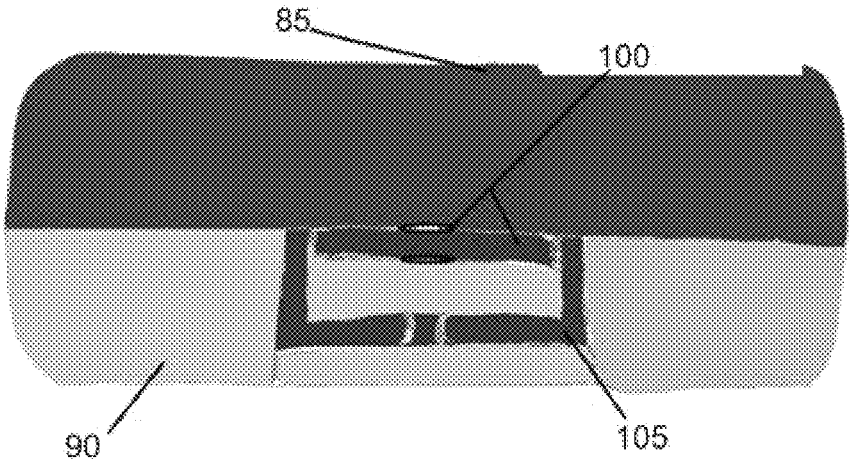

Turning now to FIGS. 2A and 2B, a triggering assembly 70 positions on the rim raising device 5. Specifically, the triggering assembly 70 joins with the sidewall 20. The triggering assembly 70 may detect a force from the at least one drum stick striking the contact portion 15 and/or the drum. The triggering assembly 70 then triggers a signal that generates a predetermined sound. The triggering assembly 70 may operate either wirelessly, or through a transducer wire 30. If a transducer wire 30 is used, the transducer wire 30 passes through the sidewall aperture 65. Otherwise, the wireless transmission of the signal may occur, without limitation, through a radio frequency, Bluetooth technology, analog, and digital.

Figure 3A:
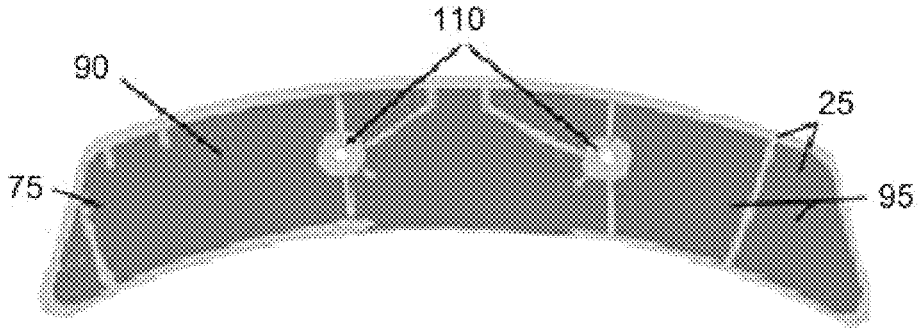
FIGS. 3A and 3B are sectioned views of an exemplary rim raising device, where
Figure 3B:
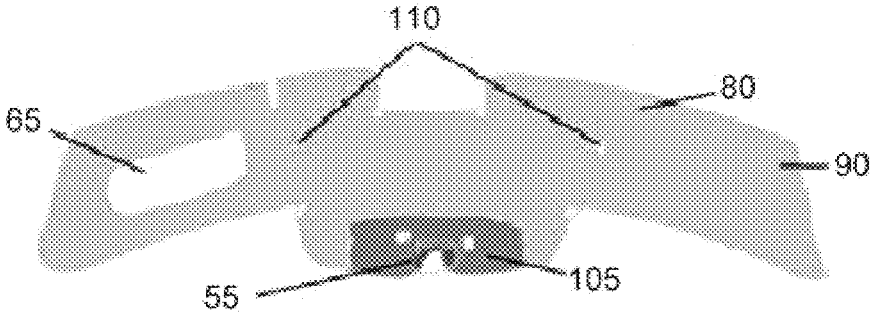

The triggering assembly 70 utilizes at least one piezoelectric sensor 60 and at least one force sensor 120 that serve as triggering mechanisms to convert the force generated by a drum stick striking the rim raising device 5 and the drum into a signal (FIGS. 3A and 3B). The signal may include an electrical signal, such as a voltage, generated by the piezoelectric effect, or change in resistance from a force resister. In some variants, the signal can wirelessly transmit to a remote trigger interface for conversion into a predetermined sound. However, the signal can also be carried through a transducer wire 30 or other cable, such as, but not limited to, an instrument cable/wire. In this manner, the rim raising device 5 may mount directly onto the drum rim, or serve as an independent instrument, remotely positioned from the drum. Additionally, the rim raising device 5 may include a device 5 to at least partially inhibit vibrations and other unwanted consequences created while performing the percussion techniques.

Figure 4A:
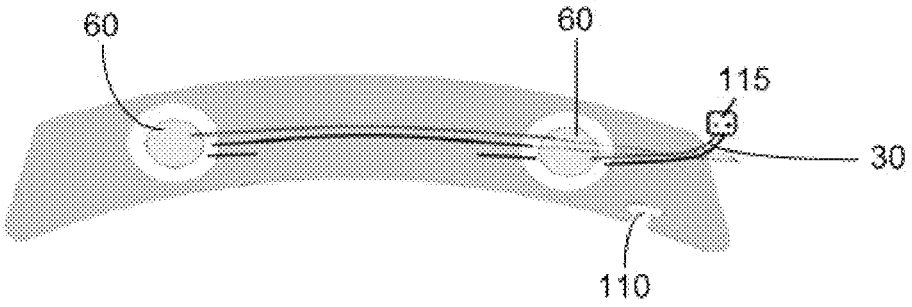
FIGS. 4A, 4B, and 4C are sectioned top views of an exemplary rim raising device, where

Turning now to FIG. 4A, the triggering assembly 70 comprises at least one piezoelectric sensor 60. The at least one piezoelectric sensor 60 is configured to convert the force of the at least one drum stick into a signal that is proportional to an intensity of the force. Those skilled in the art will recognize that the at least one piezoelectric sensor 60 is operable to measure pressure, acceleration, strain, or force produced by the drum stick striking the contact portion 15 and the drum. The force creates a deformation in a piezoelectric material, such as a piezoelectric ceramic, whereby the deformation generates a voltage. The intensity of the voltage forms the signal, which transmits to the remote trigger interface into conversion to an acoustic energy.

Figure 4B:
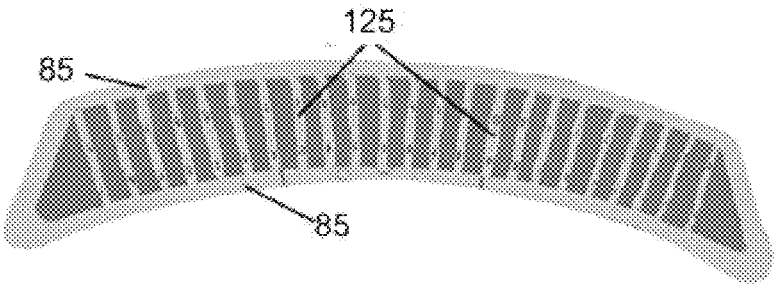
Figure 4C:
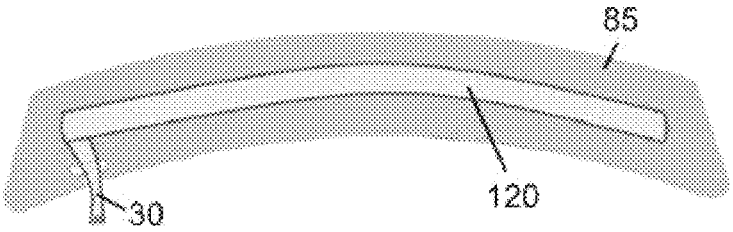

As referenced in FIGS. 4B and 4C, the triggering assembly 70 may further utilize at least one force sensor 120. The at least one force sensor 120 is configured to convert the force of the at least one drum stick into either an on signal or an off signal in the form of voltage. Unlike the at least one piezoelectric sensor 60, which generates a voltage that is proportional to an intensity of the force, the at least one force sensor 120 either generates a predetermined voltage, or does not generate any voltage. In this manner, the at least one force sensor 120 may provide two novel functions.

In one function, the at least one force sensor 120 generates a signal, comprising a predetermined linear voltage that transmits to the remote trigger interface into conversion to an acoustic energy. Those skilled in the art will recognize that the predetermined linear voltage generated by the at least one force sensor 120 forms a different acoustic energy than a signal that is proportional to an intensity of the force, such as what the at least one piezoelectric sensor 60 generates. In a second function, the at least one force sensor 120 serves as a gate or switch for actuating the at least one piezoelectric sensor 60. In this manner, the at least one piezoelectric sensor 60 may be actuated to generate a signal, not through direct contact from the drum stick, but by the force expanded onto the force sensor. In some embodiments, the at least one force sensor 120 positions above and engages the at least one piezoelectric sensor 60 for instigating contact between the two sensors 60, 120.

The force sensor 120 may include a contact strip, or a thin film force sensor 120 that may be applied onto the triggering assembly 70 through an adhesive or by painting on. The at least one force sensor 120 may further utilize a plurality of ribs 125. The plurality of ribs 125 includes rubber protrusions that extend from the triggering assembly 70 and detect the force of the drum stick striking the contact portion 15. The at least one force sensor 120 produces a linear on/off signal, rather than the signal proportional to the force, intensity dependent signal generated by the at least one piezoelectric sensor 60. In this manner, the at least one force sensor 120 serves as a gate for actuating the at least one piezoelectric sensor 60. However, in other embodiments, the at least one force sensor 120 initiates and transmits the signal to the remote trigger interface. An anchor plate 80 provides a mount for both sensors to attach to the triggering assembly 70.

The triggering assembly 70 further includes a transmitter 75. The transmitter 75 may comprise a ¼" input jack, including a mono or stereo phono connector. A cable may carry the signal from the input jack to the remote trigger interface through a contact 115. However, in another embodiment, the transmitter 75 may include a radio frequency transmitter 75 that transmits the signal wirelessly with a radio frequency or, in some variants, through Bluetooth technology. The signal may be generated and transmitted as analog or digital. The wireless transmission of the signal helps to minimize the amount of wiring, and also allows the rim raising device 5 to be used separately from the drum. In some variants, a transducer wire 30 joins the transmitter 75 with the at least one piezoelectric sensor 60 and/or the at least one force sensor 120. A barrel clamp 45 helps secure the transducer wire 30 to a housing 40. The housing 40 provides protection to the transmitter 75 from moisture and forceful impact.

The transmitter 75 is operable to transmit the signal to a remote trigger interface. The remote trigger interface is configured to convert the signal into an acoustic energy for generating the predetermined sound. The remote trigger interface may include, without limitation, a sound module, and a midi interface. In this manner, the effects of the percussion technique may be sent and heard in real time.

In one variant, the rim raising device 5 includes a vibration suppression portion 105. The vibration suppression portion 105 is configured and positioned on the arc section 10 to help suppress a vibration. Those skilled in the art will recognize that striking the drum or the rim raising device 5 may generate a sympathetic vibration, or cross talk, which occurs when a plurality of sections on the drum are engaged almost simultaneously. The vibration suppression portion 105 helps absorb and/or disperse the vibrations from the materials and positioning on the drum and the drum raising device 5.

Figure 5A:
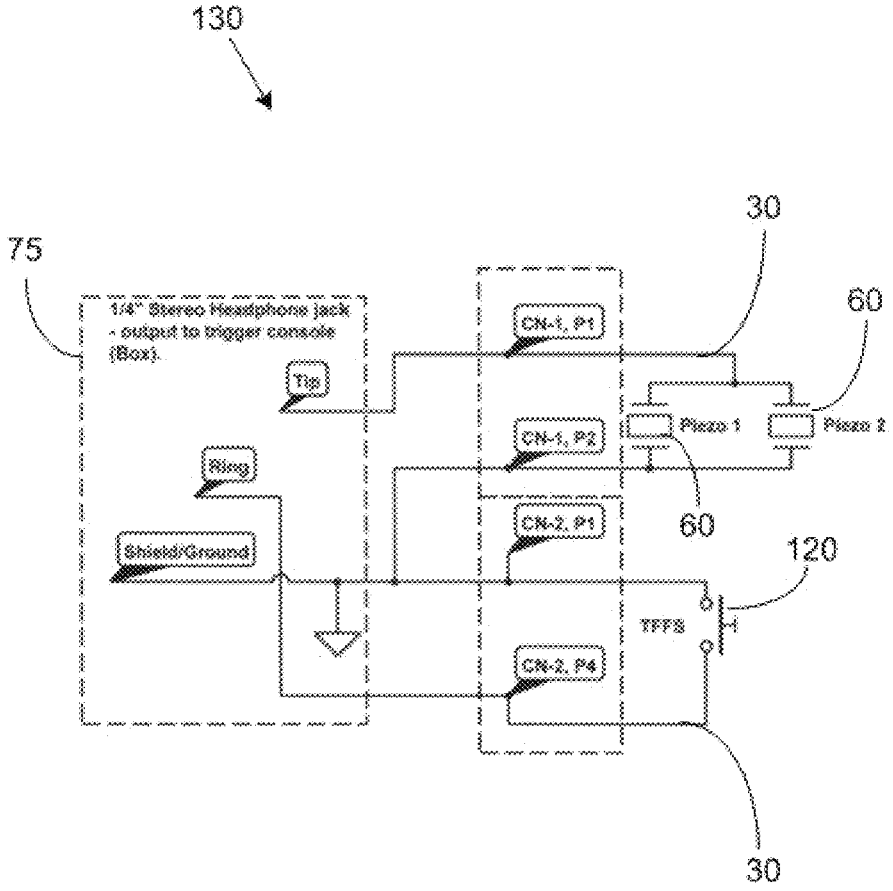
FIGS. 5A, 5B, and 5C are schematic diagrams of exemplary triggering assembly configurations, where
Figure 5B:
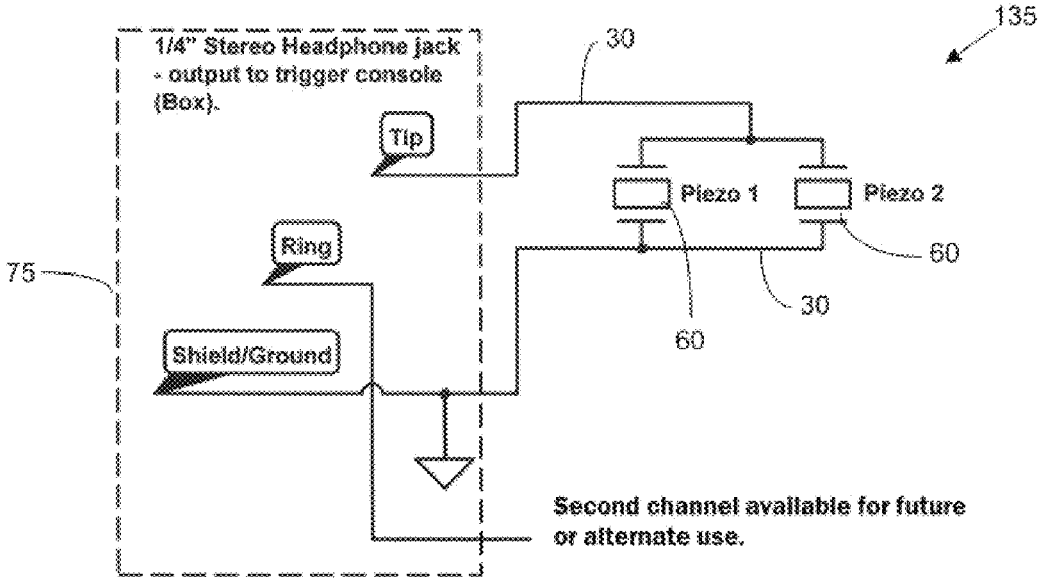
Figure 5C:
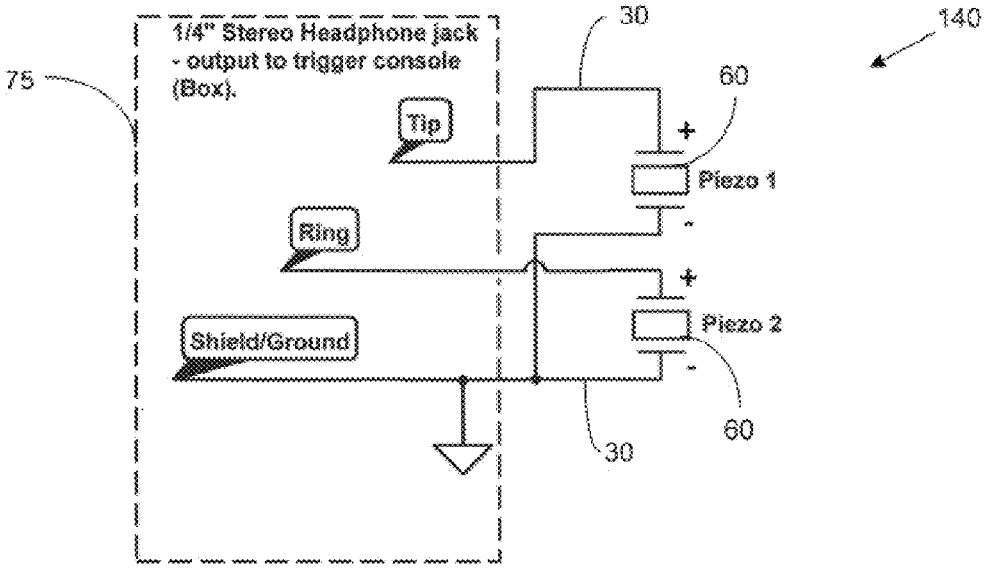

In one variant, referenced in FIG. 5A the rim raising device 5 may utilize a triggering assembly 70 having two or more piezoelectric sensors 60 and one or more force sensors 120. A cable wire may join the transmitter 75 to the remote trigger interface. This triggering assembly 70 variant may include a multi-piezo sensor with thin film force sensor 120 configuration for gated or multi-channel triggers 130. In another variant, the rim raising device 5 may utilize a triggering assembly 70 having one or more piezoelectric sensors 60, and no force sensor 120. This variant may include one or more anchor point on the flange 35, and a supplemental tension rod 55 to replace the existing tension rod 55 of the drum. This triggering assembly 70 variant may include a multi-piezo sensor with parallel configuration 135 (FIG. 5B), or a stereo/dual channel configuration 140 (FIG. 5C).

Other terms and phrases used in this document, including, the drum stick, may include, without limitation, a percussion mallet, a hand, a brush, and any other means of play, whether man made, natural striking device, or hand.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated. In addition, when a single callout line in the drawings leads to two or more separate reference numbers (first, second, etc. reference numbers), (and each reference numeral refers to a different piece of text in the detailed description) and it would be inconsistent to designate the drawing item being called out as both pieces of text, the drawing be interpreted as illustrating two different variants. In one variant, the drawing item is referred to by the first reference number and in another variant the drawing item is referred to by the second reference number, etc.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether CTRL logic or other components, can be combined in a single package or separately maintained and can further be distributed across multiple locations.

Additionally, the various embodiments set forth herein are described in terms of exemplary block diagrams, flow charts, schematics, and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A rim raising device for enhancing a percussion technique on a drum rim, comprising:

an arc section, the arc section being configured to replace an existing drum rim for enabling a more comfortable and natural grip on at least one drum stick when performing a percussion technique, and for enhancing a sound generated by striking a drum with the at least one drum stick;

the arc section comprising a contact portion, the contact portion being configured to engage the at least one drum stick and/or a body part, the arc section further comprising a mounting portion, the mounting portion being disposed to mount the arc section on a mounting surface, the arc section further comprising a sidewall, the sidewall being configured to elevate the contact portion over a circumference of the mounting surface, wherein the contact portion is spaced apart vertically above the mounting surface for creating an air space between the contact portion and the mounting surface;

a triggering assembly, the triggering assembly being configured to detect a force on the contact portion and perform a predetermined action for generating a predetermined sound, the triggering assembly comprising at least one piezoelectric sensor, the at least one piezoelectric sensor being configured to convert the force into an intensity sensitive signal that is proportional to an intensity of the force, the triggering assembly further comprising at least one force sensor, the at least one force sensor being configured to convert the force into a linear signal that is either on or off, the at least one force sensor further being configured to actuate the at least one piezoelectric sensor in response to the force, the triggering assembly further comprising a transmitter, the transmitter being configured to transmit the intensity sensitive signal and/or the linear signal to a remote trigger interface, the remote trigger interface being configured to convert the intensity sensitive signal and/or the linear signal into an acoustic energy for generating the predetermined sound;

wherein the intensity sensitive signal and the linear signal generate different acoustic energies; and a vibration suppression portion, the vibration suppression portion being configured to help suppress a vibration from the force.

2. The rim raising device of claim 1, wherein the mounting surface comprises the drum rim or a remote area.

3. The rim raising device of claim 1, wherein the arc section comprises steel or a rigid synthetic material.

4. The rim raising device of claim 1, wherein the mounting portion comprises a flange for aligning with an existing flange on the drum rim, the flange comprising at least one flange aperture for at least partially enabling a fastener to pass through at least one threaded spacer, and for attaching the rim raising device and tightening the rim raising device onto an existing tension rod of the drum.

5. The rim raising device of claim 1, wherein the mounting portion comprises at least one mounting aperture, the at least one mounting aperture being configured to enable at least partial entry of a mounting fastener for securing the rim raising device to the mounting surface.

6. The rim raising device of claim 1, wherein at least one steel spacer helps elevate the rim raising device above the drum rim.

7. The rim raising device of claim 1, wherein the triggering assembly joins with the sidewall.

8. The rim raising device of claim 1, wherein the at least one piezoelectric sensor and/or the at least one force sensor comprise an anchor plate for mounting to the sidewall through at least one sidewall aperture.

9. The rim raising device of claim 1, wherein the at least one force sensor comprises a force-sensing resistor, the force-sensing resistor being configured to change electrical resistances when said force is applied.

10. The rim raising device of claim 1, wherein the at least one force sensor comprises a plurality of ribs.

11. The rim raising device of claim 1, wherein the transmitter comprises a ¼ inch input jack and/or a radio frequency transmitter.

12. The rim raising device of claim 1, wherein a transducer wire joins the transmitter with the at least one piezoelectric sensor and/or the at least one force sensor.

13. The rim raising device of claim 1, wherein the transmitter comprises a housing for providing protection to the transmitter, the transmitter further comprises a barrel clamp for securing the transducer wire to the housing.

14. The rim raising device of claim 1, wherein the vibration suppression portion comprises an anti-vibration rubber diffusion piece, the anti-vibration rubber diffusion piece being configured to help inhibit at least one sympathetic vibration from at least one section of the drum.

15. The rim raising device of claim 1, wherein the rim raising device comprises 95% or less of the circumference of the drum rim.

16. The rim raising device of claim 1, wherein the percussion technique comprises a cross stick technique and/or a rim shot technique.

17. A rim raising device for enhancing a percussion technique on a drum rim, comprising:

an arc section, the arc section being configured to replace an existing drum rim for enabling a more comfortable and natural grip on at least one drum stick when performing a percussion technique, and for enhancing a sound generated by striking a drum with the at least one drum stick;

the arc section comprising a contact portion, the contact portion being configured to engage the at least one drum stick and/or a body part, the arc section further comprising a mounting portion, the mounting portion being disposed to mount the arc section on a mounting surface, the arc section further comprising a sidewall, the sidewall being configured to elevate the contact portion over a circumference of the mounting surface, wherein the contact portion is spaced apart vertically above the mounting surface for creating an air space between the contact portion and the mounting surface;

a triggering assembly, the triggering assembly being configured to detect a force on the contact portion and perform a predetermined action for generating a predetermined sound, the triggering assembly further comprising at least one force sensor, the at least one force sensor being configured to convert the force into a linear signal that is either on or off, and not dependent on the intensity of the force, the triggering assembly further comprising a transmitter, the transmitter being configured to transmit the linear signal to a remote trigger interface, the remote trigger interface being configured to convert the linear signal into an acoustic energy for generating the predetermined sound; and a vibration suppression portion, the vibration suppression portion being configured to help suppress a vibration from the force.

18. The rim raising device of claim 17, wherein the mounting portion comprises a flange for aligning with an existing flange on the drum rim, the flange comprising at least one flange aperture for at least partially enabling a fastener to pass through at least one threaded spacer, and for attaching the rim raising device and tightening the rim raising device onto an existing tension rod of the drum.

19. The rim raising device of claim 17, wherein the rim raising device comprises a supplemental tension rod for joining the arc section to the drum rim.

* * * * *